United States Patent [19]

Lindvall et al.

[11] 3,994,548

[45] Nov. 30, 1976

[54] SWINE CAROUSEL

[75] Inventors: Ronald N. Lindvall; Andy J. Wyatt; Merton J. G. McPeak, all of Rochester, Minn.

[73] Assignee: Babcock Swine, Inc., Rochester, Minn.

[22] Filed: July 21, 1975

[21] Appl. No.: 597,364

[52] U.S. Cl. ..... 312/197; 312/135; 312/186

[51] Int. Cl.[2] ..... A47B 47/04

[58] Field of Search ..... 312/135, 186, 196, 197, 312/202; 40/68.6

[56] References Cited

UNITED STATES PATENTS

| | | | |
|---|---|---|---|
| 562,352 | 6/1896 | Boniface | 312/197 |
| 2,711,741 | 6/1955 | Wassell | 40/68.6 |
| 3,383,147 | 5/1968 | Proulx et al. | 312/197 |

*Primary Examiner*—Casmir A. Nunberg
*Attorney, Agent, or Firm*—Merchant, Gould, Smith, Edell, Welter & Schmidt

[57] ABSTRACT

Record keeping apparatus for use in swineries for increasing efficiency of operation and ensuring that all tasks are performed in a timely manner. The apparatus comprises a console or housing in which a carousel or container is mounted for rotation in a single direction. The carousel is divided into a plurality of compartment pairs equal in number to the number of days in an arbitrarily selected time interval longer than the gestation period of sows, and the console is provided with indices or legends related to the husbandry tasks associated with such an interval. Cards representing individual sows are placed and moved in the compartments to give a visual indication of the overall status of the herd and of the work load for any particular day.

6 Claims, 3 Drawing Figures

SWINE CAROUSEL

BACKGROUND OF THE INVENTION

This invention relates to the field of animal husbandry, and specifically to record keeping apparatus for use in swineries.

Pork production on a commercial scale has reached the point where individual preferred practices must be coordinated into an integrated program and executed without fail if wastage is to be avoided of the two controlling factors usable by the husbandman, namely time and feed. A sow must be considered dispassionately as a unit for coverting time and feed into viable piglets, and her efficiency in this process must be increased and preserved by all available means.

Practical experience has led to the knowledge that there are particular times in the reproduction cycle of sows when particular changes in feeding, location, and so on, are most conducive to production of large, health litters, and a husbandman who overlooks or mistimes these changes quickly finds his operation moving below the level of profitability. In a large swinery, it is difficult to carry in memory all the data relative to the sows, and resort is had to written records identifying each animal by its ear tag number and containing pertinent dates and other useful data. Retrieval of this information on demand, and ready access to the data in convenient, usable form are very important.

SUMMARY OF THE INVENTION

This invention comprises record keeping apparatus for use by the husbandman in keeping track of the pertinent task data and future dates relating to a large number of sows, so that intended procedures will not inadvertently be overlooked, and will be carried out on their intended dates in an organized and efficient fashion.

The apparatus comprises a "console" or housing within which is mounted a "carousel" or container arranged to rotate about a vertical axis and divided into a number of radially extending pairs of compartments equal to the number of time units, in this case days, in a predetermined interval or time period which is defined by but longer than the reproductive cycle of sows. The container is taller than the housing and hence projects above it at its center. The housing bears angularly spaced legends or indicia with respect to which the container rotates: these indicia are located at positions about the container angularly proportional to the number of days from the beginning of the cycle to the day of the particular event. The compartments are arranged for receiving individual record cards, each representative of a particular sow. The container is to be rotated by one time unit each day, so that in use the cards in any compartment represent the individual sows which should be subjected to a particular treatment indicated by the legend with which the compartment is angularly aligned.

Various advantages and features of novelty which characterize the invention are pointed out with particularly in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
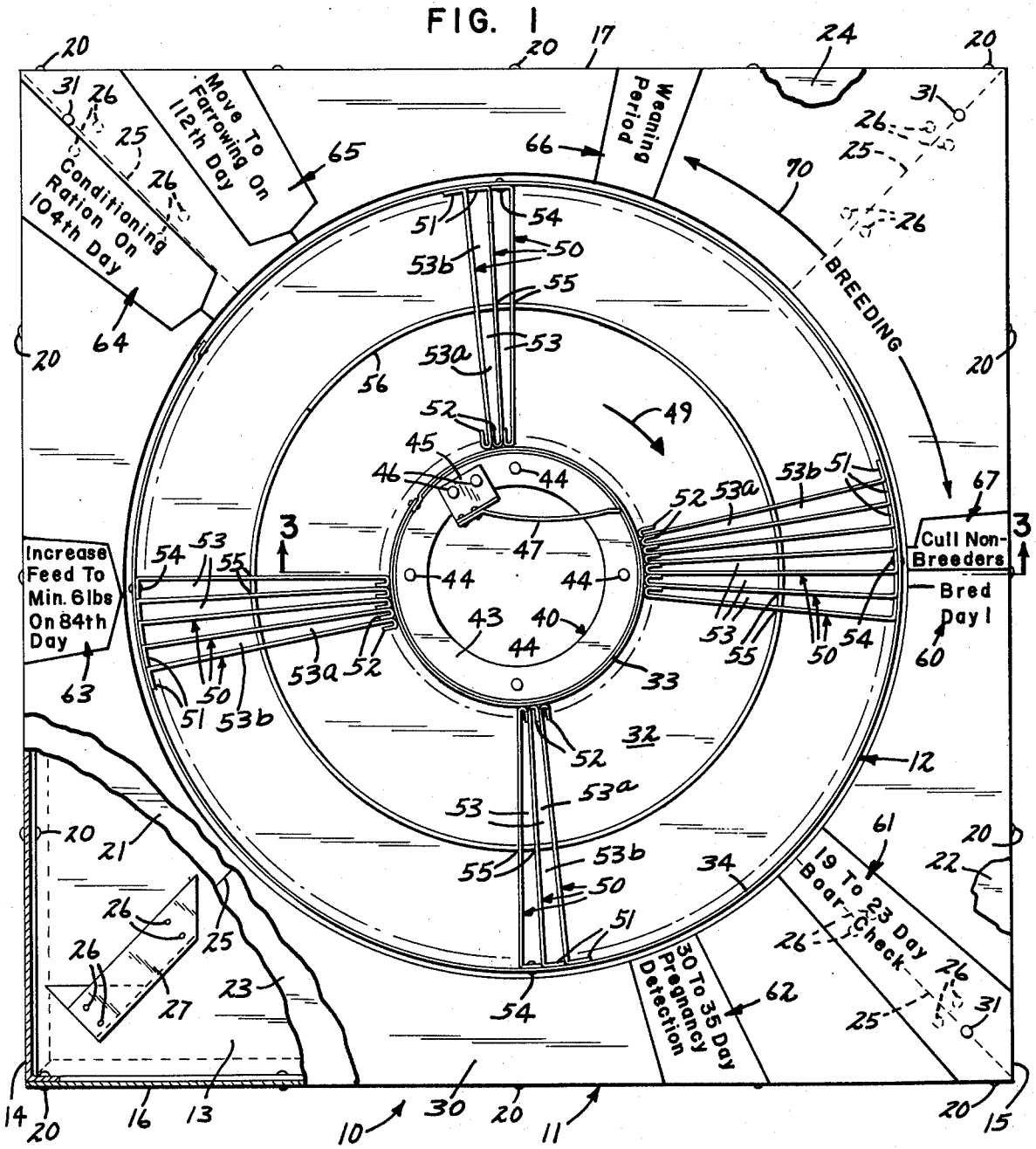
FIG. 1 is a plan view of the invention.
Figure 2:
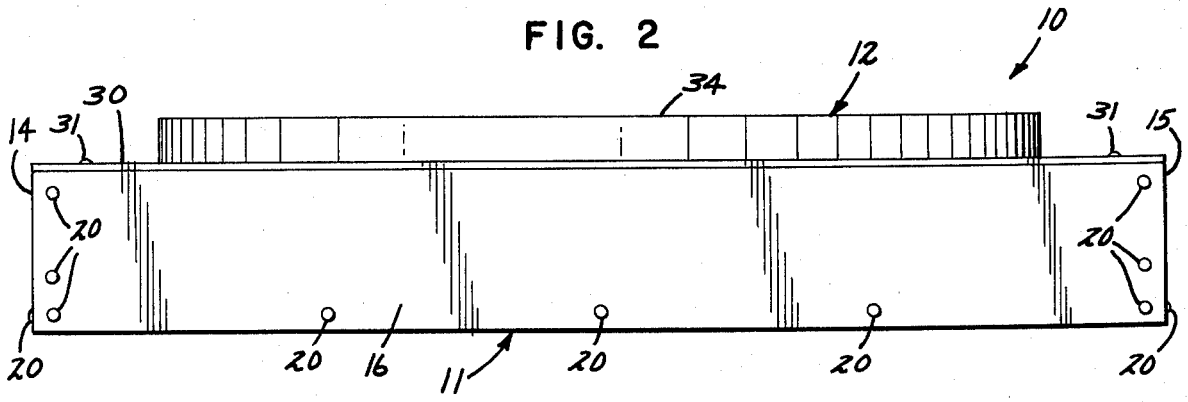
FIG. 2 is a view of the invention in elevation.
Figure 3:
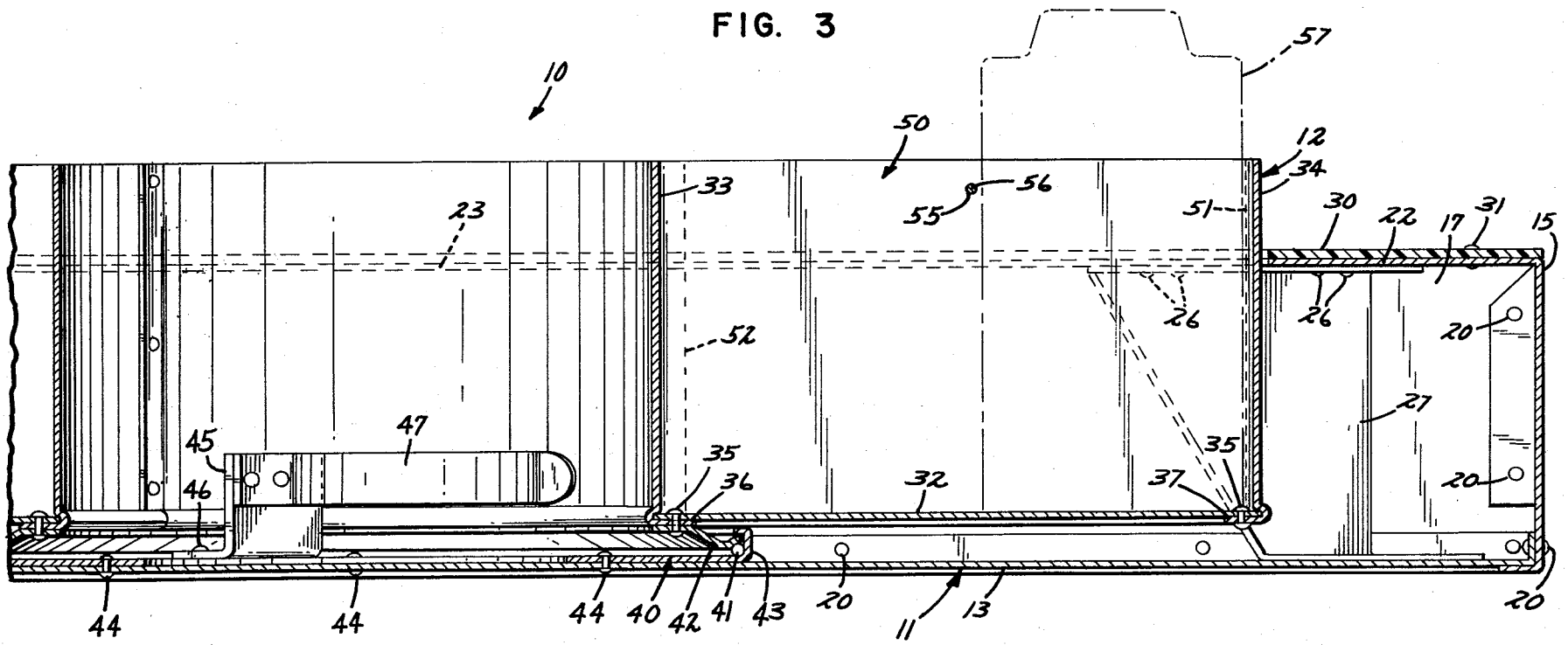
FIG. 3 is a fragmentary sectional view along the line 3—3 of FIG. 1, to a larger scale.

As shown in the drawing, record keeping apparatus 10 according to the invention comprises a housing or console 11 enclosing a record container or carousel 12. Housing 11 is constructed of sheet metal, and is conveniently built up from five principal portions, a bottom 13, a pair of sides 14 and 15, a front 16, and a back 17, riveted together according to good sheet metal practice as at 20. The sides, front, and back are unitary with top portions 21, 22, 23, and 24, respectively, which abut along the miters 25 and are joined by rivets 26 to brackets 27 at the four corners. A panel 30 of plexiglass is secured on top of portions 21–24 as by rivets 31, and is silk-screened with a plurality of indicia or legends as will presently be described.

Container 12 is of generally cylindrical configuration with a hollow center and an open end. It is made up of an annular bottom 32, a cylindrical inner wall 33, and a cylindrical outer wall 34, suitably interconnected as by rivets 35 securing flanges 36 of wall 33 and flanges 37 of wall 34 to bottom 32. A pivotal connection between members 11 and 12 is provided by an anti-friction bearing 40 including a plurality of balls 41 contained in a race having a first annular portion 42 secured to bottom 32 and a second portion 43 riveted to bottom 13 as at 44.

A bracket 45 is secured to bottom 13 as at 46 and carries a resilient finger 47, the end of which bears against the outside surface of inner wall 33. The angle of engagement between finger 47 and wall 33 is such that rotation of the container in the clockwise direction, as seen at 49 in FIG. 1, is not impeded, but rotation in the opposite direction is substantially prevented.

The container 12 is divided into a plurality of compartments by partitions 50. They are of the same height as walls 33 and 34, and their length is the same as the distance between the walls. The outer ends of partitions 50 have transverse members 51 in the form of right angle bends, and the inner ends of the partitions have transverse members 52 in the form of reverse bends spaced from the rest of the partitions. In one embodiment of the invention, 170 of such partitions are used. Transverse members 51 have the length of the chord, at the radius of wall 34, of an angle of 360°/170, or 2.12°. Transverse members 52 are sized to occupy a space having the length of the chord, at the radius of wall 33, of the same angle. It will thus be clear that when 170 partitions are inserted into container 12, the volume of the container between walls 33 and 34 is completely occupied by the partitions in a manner which defines 170 compartments 53 tapering inwardly from the edge of the container towards its center. These compartments receive the record cards used in the apparatus, each compartment being large enough to contain numerous record cards. At selected points about the periphery of the container, particular partitions are secured to the wall 34, as by rivets 54.

Each partition also has an aperture 55 along its upper edge, and these apertures are circumferentially aligned about a circle lying halfway between walls 33 and 34. A ring 56 passes through apertures 55, and serves to divide the compartments into inner and outer sections 53*a* and 53*b*.

A record card 57 intended for use in this apparatus is shown to be tall enough to project about the tops of partitions 50 and walls 33 and 34, and narrow enough to fit either compartment section 53*a* or section 53*b*, to be carried past the indicia on panel 30, as will now be explained.

While the invention here is disclosed for use in keeping records of a swinery, it is useful generally for monitoring the progress of individual subjects through a predetermined sequence of events occurring at predetermined intervals through a predetermined time period. In the embodiment shown there are 170 timed units in the time period. The time units are days, the individuals are particular sows, and the total period is 170 days. The events of significance are indicated by the legends on panel 30.

The first legend indicated at reference numeral 60 identifies Day 1. The second legend 61 identifies the compartments spaced from Day 1 by 19 to 23 days. Legend 62 identifies the compartments spaced from Day 1 by 30 to 35 to days. Legend 63 identifies the compartment spaced from Day 1 by 84 days, legend 64 identifies the compartment spaced from Day 1 by 104 days, legend 65 identifies the compartment spaced from Day 1 by 112 days, legend 66 identifies the compartments spaced from Day 1 by 133 to 140 days, and legend 67 identifies the compartment spaced from Day 1 by 170 days.

The physical operation of the record keeping apparatus itself involves nothing more than advancing container 12 by 1 day each morning. This will bring an empty compartment into alignment with legend 60, and for convenience the user may gum to this compartment a label indicating what calendar day it represents. The convenience and utility of the apparatus will be best illustrated by assuming that the system is fully in use at an operative swinery.

The program of operation of the swinery requires definite steps to be accomplished as a part of the day's activity. First, a number of sows are to be bred. Each sow is represented by a card 57 carrying the ear tag number of the animal. The record keeper will place the appropriate cards in section 53*a* of the Day 1 compartment. As he is informed that the breeding has been completed, the cards in question are transferred to section 53*b* of that compartment. For all compartments, section 53*a* is for work to be done and section 53*b* is for completed work.

In order to minimize the feeding of unproductive sows, it is important to determine whether each breeding has been successful. Pregnancy detection instrumentation is available, but it not reliable before about the thirtieth day after breeding. A rough and ready check of the success of the breeding is to present the boar to the sow again: if she accepts him, the prior breeding is shown to have been unsuccessful. If she does not receive him, the previous breeding may still have been unsuccessful, but this is less common. Accordingly, the record keeper refers to compartments aligned with legend 61, and moves the cards in these compartments to sections 53*a* and directs that a boar check be made of the sows identified by these cards. If the sow accepts the boar, her card is returned to section 53*b* aligned with Day 1. If she refuses him, her card is transferred from section 53*a* back to section 53*b* of the same compartment. Again, tasks to be done are in the inner section and completed tasks are in the outer section: a card may chance to remain in a section 53*a* for several days depending on the work load, but its presence there insures that no operation will be overlooked completely on any subject.

The record keeper also transfers the cards from section 53*b* to section 53*a* of the compartments in alignment with legend 62. It is at this stage that the instrumental check of the sows for pregnancy is reliable. The cards for sows checking as pregnant are returned to section 53*b* of the same compartment, while those for sows not pregnant are set aside for rebreeding or for culling, depending on the more complete details of the sows previous history.

It has been found economical to feed sows at a first rate through the earlier stages of pregnancy, and to increase its feeding rate later. The 84th day from Day 1 is believed to be a optimum time for this change in feeding. Accordingly, the record keeper moves the cards in the compartment opposite legend 63 into section 53*a* of that compartment, where they remain until the increase in feeding rate of the sows has been completed: then the cards go back into section 53*b* of that compartment.

It has been found desirable to feed sows a different ration known as a conditioning ration during the last 10 days of pregnancy. The cards contained in the compartment aligned with legend 64 are moved into section 53*a* until the change in ration of the sows thus identified is accomplished, and then returned to section 53*b*.

The welfare of the offspring is best served if the sow is confined in farrowing crate during the farrowing period. For swine, the gestation period is 3 months, 3 weeks and 3 days, or 114 days. Accodingly, the sows whose cards are in the compartment aligned with legend 66 are transferred (on the 112th day to take into account the individual variances) to farrowing pens. The cards are moved to section 53*a* of the compartment, where they remain until the transfer is completed.

The growth of young pigs is such that they may be weaned 21 days after farrowing. As a practical matter, weaning may be undertaken on a once a week basis. Thus, container 12 is advanced by one space each day, cards are moved from section 53*b* to section 53*a* in up to seven compartments. When the weaning is accomplished, cards for all sows weaned in that day are moved to section 53*b* of the first compartment after those identified by legend 66. The compartments in the area indicated by the double-ended arrow 70 contain cards for sows which have been weaned, or sows returned because of a pregnancy check, and thus represent a population from which the animals to be bred at any available time may be drawn.

In recapitulation, the invention here comprises a convenient, compact apparatus for keeping records of the progress of sows through the reproductive cycle. By its use, the intended steps in husbandry of the animals are identified and the record keeper is visually reminded of what tasks remain to be accomplished in each of the steps, and a minimum loss of time and feed due to unsuccessful breeding is assured.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaing of the terms in which the appended claims are expressed.

What is claimed is:

1. Record keeping apparatus for monitoring the progress of individual subjects through a predetermined sequence of events occurring at predetermined intervals through a predetermined time period comprising, in combination:

a cylindrical container open at one end and partitioned into a number of radially extending compartments equal to the number of time units in the predetermined time period, said compartments being accessible at said open end of said container;

a housing having a central circular opening in its top sized to receive such container a plurality of fixed indicia carried by said housing adjacent said opening and spaced angularly therearound in accordance with the known time spacing of selected events occurring within said time period, at least one of said indicia identifying the beginning of said period;

and means mounting said container for rotation about a central axis in said housing with respect to said indicia so that as said container is rotated in increments of one time unit, said compartments move in succession into and past alignment with said indicia.

2. The structure of claim 1 together with means opposing rotation of said container in at least one direction.

3. The structure of claim 1 in which said compartments are divided into distinct inner and outer sections by a ring passing through circumferentially aligned holes in the partitions between said compartments.

4. A structure according to claim 2 in which said container has a hollow center surrounded by an inner wall, and the last named means includes a resilient member mounted in said housing near the center thereof and arranged to frictionally engage the outer surface of said inner wall.

5. Record keeping apparatus for monitoring the progress of individual subjects through a predetermined sequence of events occurring at predetermined intervals through a predetermined time period comprising, in combination:

a cylindrical container open at one end and partitioned into a number of radially extending compartments equal to the number of time units in the predetermined time period, said compartments being accessible at said open end of said container;

a housing having a central circular opening in its top sized to receive such container, and bordered by angularly spaced indicia pertinent to the time-spaced events occurring within said time period, at least one of said indicia identifying the beginning of said period;

and means mounting said container for rotation about a central axis in said housing with respect to said indicia so that as said container is rotated in increments of one time unit, said compartments move in succession into and past alignment with said indicia, in which said container comprises an annular bottom, inner and outer cylindrical walls, and a pluarality of partitions of length equal to the distance between said walls, said partitions having first transverse end members equal to the chord, at the radius of said outer cylindrical wall, of an angle of 360 degrees divided by the number of said partitions, and second transverse end members equal to the chord of the same angle at the radius of the inner cylindrical wall.

6. The structure of claim 5 in which said partitions have circumferentially arranged apertures at their upper edges traversed by an aligning ring, and in which selected ones of said partitions are secured to said outer cylindrical wall by fastenings passing through their first transverse members.

* * * * *